US006911154B2

(12) United States Patent
Bourcheix

(10) Patent No.: US 6,911,154 B2
(45) Date of Patent: Jun. 28, 2005

(54) METHOD FOR MANUFACTURING A CATHODE WITH AN ALIGNED EXTRACTION GRID AND FOCUSING GRID

(75) Inventor: Christophe Bourcheix, Mauguio (FR)

(73) Assignee: Commissariat a l'Energie Atomique, Paris (FR)

( * ) Notice: Subject to any disclaimer, the term of this patent is extended or adjusted under 35 U.S.C. 154(b) by 388 days.

(21) Appl. No.: 10/029,902

(22) Filed: Dec. 21, 2001

(65) Prior Publication Data

US 2002/0114882 A1 Aug. 22, 2002

(30) Foreign Application Priority Data

Dec. 22, 2000 (FR) ..... 00 16979

(51) Int. Cl.[7] ..... B44C 1/22

(52) U.S. Cl. ..... 216/11; 216/24; 216/39; 216/41; 438/20

(58) Field of Search ..... 216/11, 24, 39, 216/41; 438/20

(56) References Cited

U.S. PATENT DOCUMENTS 3,998,678 A * 12/1976 Fukase et al. ..... 216/11

6,165,374 A * 12/2000 Cathey et al. ..... 216/11

FOREIGN PATENT DOCUMENTS

| | | |
|---|---|---|
| EP | 0 930 634 | 7/1999 |
| FR | 2 779 271 | 12/1999 |

* cited by examiner

*Primary Examiner*—Shamim Ahmed
(74) *Attorney, Agent, or Firm*—Duane Morris LLP

(57) ABSTRACT

A method for manufacturing a structure, including the steps of forming on the substrate a piling of a first insulating layer, a first metallization level, a second insulating layer, and a second metallization level, opening in the second metallization level and in the second insulating layer first windows corresponding to the contour of the first openings and second windows, the external contour of which corresponds to the internal contour of the second openings, forming in a masking layer third windows larger than the first windows, etching the first metallization level in the first windows, removing the second metallization level under the masking layer to as far as the internal periphery of the second windows, etching by a chosen distance the first insulating layer, and simultaneously removing the second insulating layer within the contour of the second windows, and removing the masking layer.

7 Claims, 3 Drawing Sheets

METHOD FOR MANUFACTURING A CATHODE WITH AN ALIGNED EXTRACTION GRID AND FOCUSING GRID

BACKGROUND OF THE INVENTION

1. Field of the Invention

The present invention generally relates to the manufacturing of self-aligned structures in multiple-layer devices. It more specifically relates to the manufacturing of a microtip cathode of a flat display screen.

The operating principle and the detail of the forming of an example of a microtip screen are described in U.S. Pat. No. 4,940,216 to the Commissariat à l'Energie Atomique to which reference will be made for any general teaching on this type of screen. Usually, a flat microtip screen is formed from two glass plates. The lower plate includes a microtip cathode structure, and one or several grid structures. The upper plate, arranged in operation to face the lower plate, supports an anode structure. The elementary microtips are arranged in various ways, and can be selectively addressed by acting upon perpendicular cathode and extraction grid lines. Generally, a large number of microtips are simultaneously addressed for each pixel of a screen.

The present invention more specifically aims at the forming of a screen of the type illustrated in FIG. 1. This screen includes a lower surface or cathode plate 1 and an upper plate or anode plate 2. The upper surface includes a layer, lines or pixels of phosphor material 3.

2. Discussion of the Related Art

On cathode plate 1, an upper layer corresponds to conductive cathode lines, possibly covered with a resistive material. On these cathode lines are formed microtips 5 in openings of an extraction grid 6. Extraction grid 6 is formed on a first insulating layer 7 formed on the upper surface of cathode 1. This upper surface will be said to correspond to the upper surface of the system substrate. Above grid layer 6 is formed a second insulating layer 8 in which a second conductive layer 9 corresponding to a focusing grid is laid. In this focusing grid and in second insulating layer 8 are formed openings which must be arranged precisely with respect to the openings formed in the extraction grid.

Various methods, for example described in French patent application 2,779,271 of the Commissariat à l'Energie Atomique, are known to form in a self-aligned manner the openings in the two metal levels 6 and 9 and in insulating layers 7 and 8. However, these methods appear in practice to be either inaccurate or difficult to implement. Further, these methods do not always enable independently and accurately adjusting the recess of the etching of the first insulating layer with respect to the second conductive layer and the recess of the etching of the second conductive layer with respect to the first conductive layer.

SUMMARY OF THE INVENTION

Thus, an object of the present invention is to provide a method for manufacturing structures comprised of two metallization levels and openings precisely defined with respect to one another in each of the two levels and in the underlying insulating layers.

A more specific object of the present invention is to provide such a method which is applicable to the manufacturing of microtip screens.

To achieve these objects, the present invention provides a method for manufacturing a structure including on a substrate a first metallization level separated from the substrate by a first insulating layer and a second metallization level separated from the first metallization level by a second insulating layer, first openings being formed in the first metallization level and in the first insulating layer, and second openings, larger than the first ones being defined in the second metallization level and the second insulating layer. This method includes the steps of forming on the substrate a piling of a first insulating layer, of a first metallization level, of a second insulating layer, and of a second metallization level, opening in the second metallization level and in the second insulating layer first windows corresponding to the contour of the first openings and second strip-shaped windows, the external contour of which corresponds to the internal contour of the second openings, forming in a masking layer covering the structure third windows larger than the first windows, etching the first metallization level in the first windows, removing the second metallization level under the masking layer to as far as the internal periphery of the second windows, etching by a chosen distance the first insulating layer, and simultaneously removing the second insulating layer within the contour of the second windows, removing the masking layer.

According to an embodiment of the present invention, the etchings of the second metallization level, of the second insulating layer, and of the first metallization level according to the contour of the first windows are vertical anisotropic etchings.

According to an embodiment of the present invention, the first and second metallization levels are made of distinct selectively etchable materials.

According to an embodiment of the present invention, the material of the first metallization level is niobium and the material of the second metallization level is chromium.

According to an embodiment of the present invention, each second opening surrounds a first opening.

According to an embodiment of the present invention, each second opening surrounds a group of first openings.

The foregoing objects, features and advantages of the present invention will be discussed in detail in the following non-limiting description of specific embodiments, in conjunction with the accompanying drawings.

DETAILED DESCRIPTION

Figure 2:
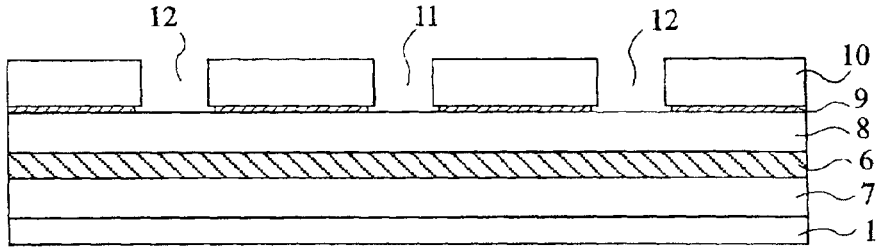
FIGS. 2 to 8 are simplified cross-section views illustrating successive steps of the manufacturing of a structure according to the present invention.

As shown in FIG. 2, to form a structure according to the present invention, a piling of layers successively corresponding to substrate 1, to first insulating layer 7, to first metallization level 6, to second insulating layer 8, and to second metallization level 9 is first formed. On this metallization level, a photosensitive material resist layer 10 is formed. Then, by photolithographic etching, windows are successively opened in resist layer 10 and in second metallization level 9. The etching in second metallization level 9 is performed by any isotropic or anisotropic etching method.

The windows formed in layer 10 include, on the one hand, first windows 11 having the shape of the first openings which are desired to be formed in first metallization level 6, and on the other hand, second strip-shaped windows 12 having a desired closed contour, the external edge of which corresponds to the internal contour of the second openings which are desired to be formed in second metallization level 9.

Figure 3:
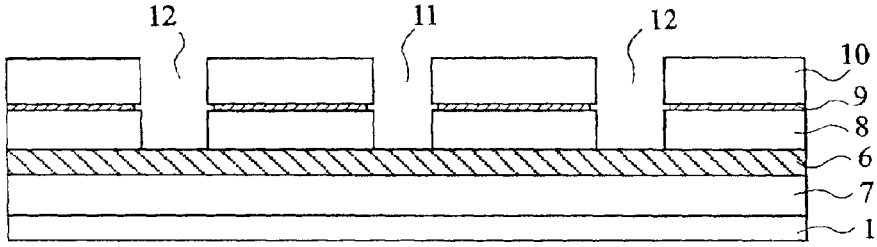

At the step illustrated in FIG. 3, the openings are prolonged by etching second insulating layer 8, by any vertical anisotropic etching method, for example, by plasma etching.

Figure 1:
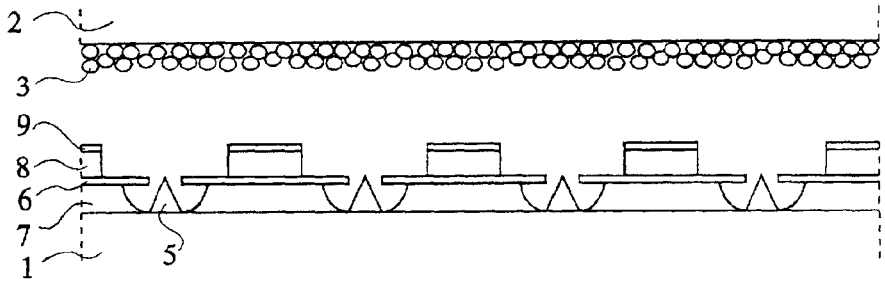
FIG. 1 shows a simplified cross-section view of a structure that the present invention aims at forming.
Figure 3A:
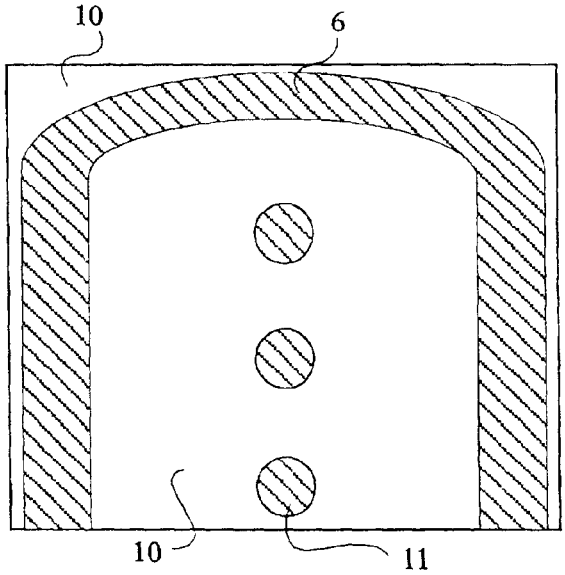
FIGS. 3A, 5A, and 8A are top views respectively corresponding to the steps of FIGS. 3, 5, and 8.

FIG. 3A shows an example of a top view of the structure shown in cross-section in FIG. 3. It shows the shape of first windows 11 and of a second strip-shaped window 12. It should be noted that the shapes of the various windows shown in this top view are an example only of embodiment of the present invention. The first windows will generally have a circular shape substantially identical to that shown, to receive tips 5, as shown in FIG. 1. However, the second windows may have any chosen shape. It may be circular rings concentric to the first windows, each second opening including a single first opening. It may be, as shown, a strip surrounding a plurality of first openings. These first openings may be arranged in a line, as shown, or grouped in any other desired manner. Further, the contours of the second openings may be chosen to obtain any desired focusing effect.

Figure 4:
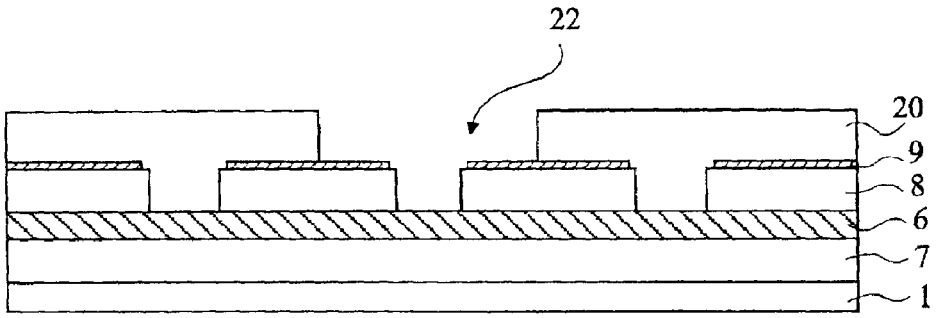

At the step illustrated in FIG. 4, resist layer 10 is removed and a second resist layer 20 which, in particular, fills up the second windows, is deposited. Then, a third window 22 is opened in resist layer 20. Third window 22 surrounds each of the first windows or an assembly of first windows, but does not cut the second windows illustrated in FIGS. 3 and 3A.

Figure 5:
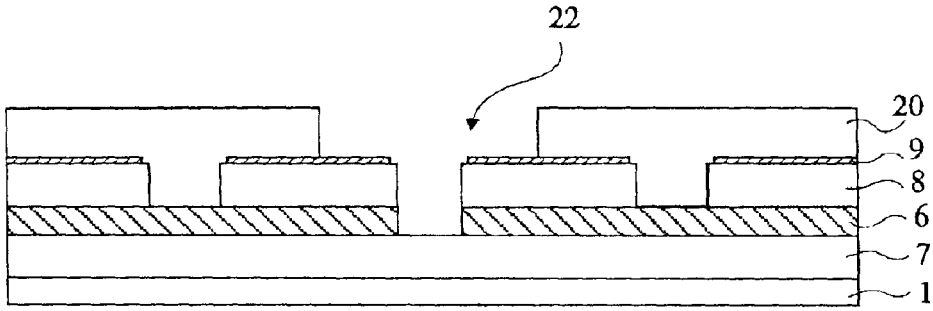

At the step of FIG. 5, by using the mask corresponding to the openings in second metallization level 9 and in first insulating layer 8, first metallization level 6 is opened to thus form therein first desired openings corresponding to the contour of the first windows.

Figure 5A:
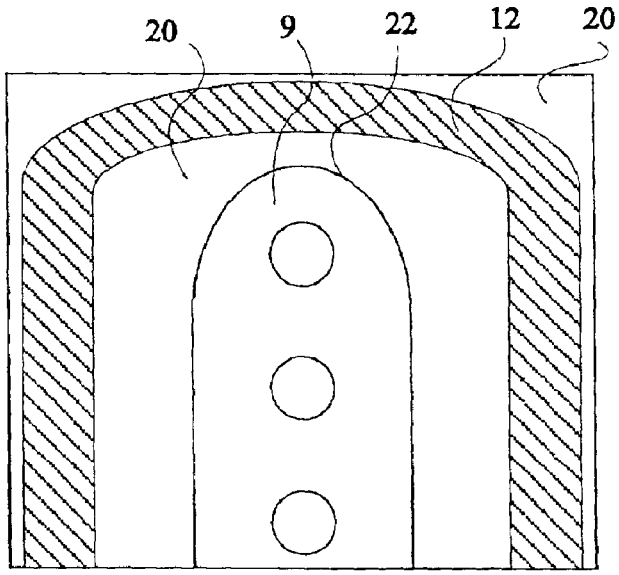

FIG. 5A shows an example of a top view of the structure shown in cross-section in FIG. 5. It shows an example of shape of third window 22.

Figure 6:
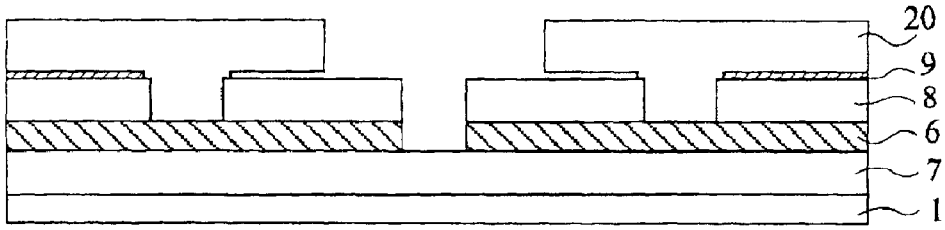

At the step illustrated in FIG. 6, second metallization level 9 is first removed by wet etching from its upper surface exposed by the third window and this wet etching is continued to laterally remove the entire second metallization level to as far as internal contour 2 of the second annular windows. A specific wet etching product enabling etching the second metallization level and not (or very slightly) the materials of the first and second insulating layers and the material of the first metallization level will be used.

Figure 7:
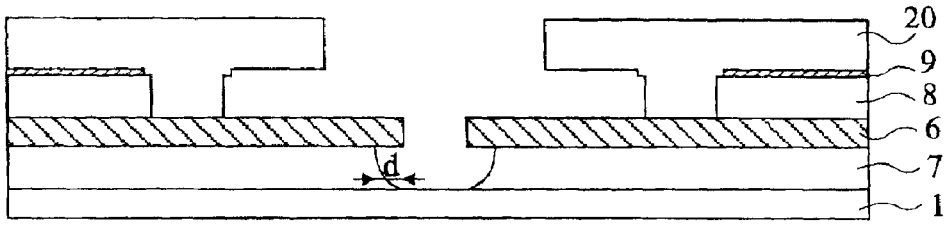

At the step illustrated in FIG. 7, assuming that the first and second insulating layers are made of a same material, or at least of materials etchable by a same etch product, a wet etching of these insulating layers is performed. The entire portion of second insulating layer 8 located within the internal contour of the second window is removed, both by lateral etching from the opening corresponding to the first window and by vertical etching by the etch product penetrating into the interval between the second metallization level and resist layer 20. Thus, second insulating layer 8 is removed very quickly. The etch duration is chosen so that a recess formed by the etching in the first insulating layer 7 has a predetermined amount of undercut d with respect to the contour of the first opening. The wet etching may be preceded with a partial anisotropic etching.

Figure 8:
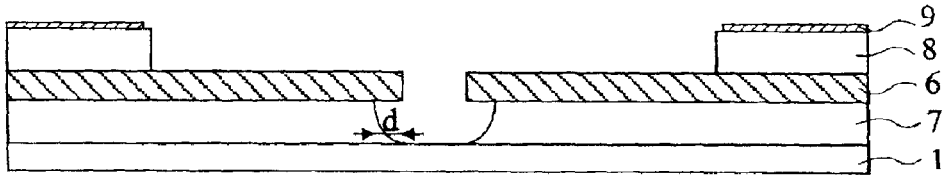
Figure 8A:
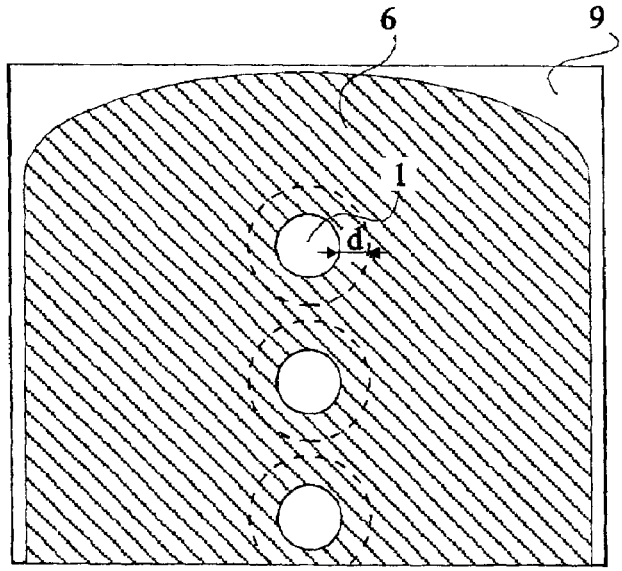

Finally, at the step illustrated in FIG. 8, second resist layer 20 has been removed to obtain the desired structure. Thus, as shown in cross-section view in FIG. 8 and in top view in FIG. 8A, first openings in first metallization level 6, an etching in the underlying layer recessed by a distance d well determined with respect to this opening, and a second opening in second metallization level 9 and first insulating layer 8, the distance of which is perfectly well determined by the single mask used at the step of FIG. 2, have been formed. The dimension of this second opening is determined, in particular, independently from any etch operation on the first insulating layer. It should be noted that the third mask of FIG. 4 is not critical and that none of the dimensions of the final structure depends on its contour.

Various materials and techniques may be used by those skilled in the art to form the desired structure. For example, the first and second insulating layers may be silicon oxide, the first metallization level may be niobium, and the second metallization level chromium. However, other materials may be chosen and, as previously indicated, other shapes may be used for the second openings in the second metallization level and the underlying insulating layer.

Of course, the present invention is likely to have various alterations, modifications, and improvements which will readily occur to those skilled in the art. Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method for manufacturing a structure on a substrate a first metallization level separated from the substrate by a first insulating layer and a second metallization level separated from the first metallization level by a second insulating layer, first openings, having a contour, being formed in the first metallization level and in the first insulating layer, and second openings, having an internal contour, larger than the first ones being defined in the second metallization level and the second insulating layer, the method including the steps of:

forming on the substrate a piling of a first insulating layer, a first metallization level, a second insulating layer, and a second metallization level;

opening first windows and second strip-shaped windows in the second metallization level and in the second insulating layer, the second windows having an internal contour and an external contour, wherein the first windows correspond to the contour of the first openings and the external contour of the second windows corresponds to the internal contour of the second openings;

depositing a masking layer filling the second strip-shaped windows;

forming third windows, larger than the first windows, in the masking layer;

removing the first metallization level in the first windows;

removing the second metallization level in the third windows and under the masking layer out to the internal contour of the second windows, etching the first insulating layer forming a recess, and simultaneously removing the second insulating layer within the internal contour of the second windows; and removing the masking layer.

2. The method of claim 1, wherein the steps of removing the second metallization level, the second insulating layer, and the first metallization level are accomplished by vertical anisotropic etchings.

3. The method of claim 1, wherein the first and second metallization levels are made of distinct selectively etchable materials.

4. The method of claim 1, wherein the first metallization level is made of niobium and the second metallization level is made of chromium.

5. The method of claim 1, wherein each second opening surrounds a first opening.

6. The method of claim 1, wherein each second opening surrounds a group of first openings.

7. The method of claim 1, wherein the step of etching the first insulating layer involves etching for a predetermined duration resulting in formation of a recess in the first insulating layer having a predetermined amount of undercut with respect to the contour of the first opening.

* * * * *